US007267383B2

(12) United States Patent
Bilsing

(10) Patent No.: US 7,267,383 B2
(45) Date of Patent: Sep. 11, 2007

(54) METHOD AND SUPPORT ARRANGEMENT FOR FIXING AND DEMOUNTING A GRIPPER TOOL TO THE TRANSVERSE BEAM OF A TRANSFER PRESS

(75) Inventor: Alfred Bilsing, Attendorn (DE)

(73) Assignee: Bilsing Automation GmbH (DE)

( * ) Notice: Subject to any disclaimer, the term of this patent is extended or adjusted under 35 U.S.C. 154(b) by 101 days.

(21) Appl. No.: 11/137,572

(22) Filed: May 26, 2005

(65) Prior Publication Data

US 2005/0265640 A1 Dec. 1, 2005

(30) Foreign Application Priority Data

May 28, 2004 (DE) ..... 10 2004 026 245

(51) Int. Cl.
*B25J 15/06* (2006.01)
*B66C 1/02* (2006.01)

(52) U.S. Cl. ..... 294/65; 403/409.1

(58) Field of Classification Search ..... 294/64.1, 294/65; 414/627, 737, 752.1; 403/409.1; 248/222.13, 229.11
See application file for complete search history.

(56) References Cited

U.S. PATENT DOCUMENTS 4,129,328 A * 12/1978 Littell ..... 294/65
4,650,234 A * 3/1987 Blatt ..... 294/65
4,941,768 A * 7/1990 Arendt ..... 403/331
4,957,318 A * 9/1990 Blatt ..... 294/64.1
5,135,276 A * 8/1992 Blatt et al. ..... 294/65
5,152,566 A * 10/1992 Blatt et al. ..... 294/81.2
5,746,567 A 5/1998 Herbermann et al.
6,863,323 B2 * 3/2005 Neveu ..... 294/65

FOREIGN PATENT DOCUMENTS

EP 1 402 970 3/2004

* cited by examiner

*Primary Examiner*—Dean J. Kramer
(74) *Attorney, Agent, or Firm*—Stites & Harbison PLLC; Marvin Petry

(57) ABSTRACT

A method and an apparatus serve to secure a gripper tool detachably to a movable crossbar of a transfer press. The gripper tool has two saddles, with spacing between them, which are brought into engagement with two bearings mounted on the crossbar and locked in a defined engagement position. To attain faster, simpler assembly, the gripper tool is introduced in an inclined position relative to the crossbar, by at least one protrusion of rounded longitudinal section or tapering in wedgelike fashion, on the first saddle, into a correspondingly rounded or V-shaped narrowing recess in the first bearing. The second saddle is then pivoted toward the crossbar. In the process, wedge faces on the second saddle and on the second bearing press the protrusion axially against the wall of the recess by the force of gravity. In the end position, the second saddle is locked to the second bearing.

14 Claims, 7 Drawing Sheets

METHOD AND SUPPORT ARRANGEMENT FOR FIXING AND DEMOUNTING A GRIPPER TOOL TO THE TRANSVERSE BEAM OF A TRANSFER PRESS

FIELD OF THE INVENTION

The invention relates to a method for detachably securing a gripper tool to a movable transverse beam, normally called crossbar, of a transfer press, which gripper tool has two saddles disposed with spacing between them and with them is brought into engagement with two bearings mounted on the crossbar and is locked in a defined engagement position, and to a bearing assembly for performing such a method.

BACKGROUND OF THE INVENTION

From U.S. Pat. No. 5,746,567, it is known for a gripper tool, comprising two saddles and two supporting tubes to which suction grippers are secured, to be placed first with both saddles on the crossbar of a transfer press and then displaced along the crossbar, overcoming friction, by means of a clamping and locking lever in order to bring parallel wedge faces on both sides simultaneously into contact with corresponding wedge faces on bearings fixedly connected to the crossbar, and furthermore during this motion to introduce centering bolts into fitting centering bores on the saddles and bearings, respectively. The time and force required for horizontally displacing the gripper tool on the crossbar and forcing it between the crossbars is problematic.

OBJECT AND SUMMARY OF THE INVENTION

It is therefore the object of the invention to make a method and a bearing assembly of the type defined above available that permit faster, simpler, positionally precise fastening and fixation of the gripper tool to the crossbar.

This object is attained in terms of the method, as proposed by the invention, in that the gripper tool, in an inclined position relative to the center longitudinal axis of the crossbar, is introduced, with at least one protrusion of rounded longitudinal section or tapering in wedgelike fashion, on the first saddle into a correspondingly rounded or V-shaped narrowing recess in the first bearing and is then pivoted with the second saddle toward the crossbar, whereupon wedge faces on the second saddle and on the second bearing press the protrusion by the force of gravity axially against the wall of the recess, and then the second saddle is locked to the second bearing.

The invention offers the advantage that for precise positioning of the gripper tool, it suffices to introduce one end of it, having the protrusion, into the associated recess in the first bearing and then to lower the other end of the gripper tool or let it drop. During this pivoting motion, the cooperating wedge faces on the second saddle and on the second bearing come into contact with one another and automatically push the gripper tool into its predetermined position relative to the crossbar. In this end position, the gripper tool is clamped between the wedge face on the second bearing and the recess on the first bearing. Next, this end position of the gripper tool merely needs to be secured by locking the second saddle to the second bearing. To that end, preferably at least one locking bolt, axially guided in the second bearing, is introduced, in the direction parallel to the center longitudinal axis of the crossbar, into a fitting bore in the second saddle. In the process, by means of cooperating wedge or conical faces on the locking bolt and on the bore, it can be assured that in a case where the gripper tool is not yet aligned precisely parallel to the center longitudinal axis of the crossbar, it is pivoted a little farther during the locking until it reaches the predetermined end position.

In a further preferred feature of the invention, in the pivoting of the gripper tool into the predetermined end position, underpressure supply lines are connected to underpressure lines on the tool via cooperating pneumatic couplings on the second bearing and on the second saddle. Since the pivoting of the gripper tool takes place automatically by gravity, for this coupling operation as well no additional manipulation or expenditure of force is needed.

The bearing assembly of the invention is distinguished in that the first saddle can be introduced, with at least one protrusion mounted on it and having a rounded longitudinal section or tapering in wedgelike fashion, already in an inclined position of the gripper tool relative to the center longitudinal axis of the crossbar, into a correspondingly rounded or V-shaped narrowing recess in the first bearing, and in the engagement position the gripper tool can be pivoted with the second saddle toward the crossbar; that the second saddle and the second bearing are provided with wedge faces, which in the course of the pivoting motion come to rest on one another, by which faces the protrusion can be pressed axially against the wall of the recess by the force of gravity; and that in this braced position, the second saddle can be locked to the second bearing.

On its free end the protrusion may have an approximately semicylindrical shape, for example, with a cylinder axis that in the mounted state of the gripper tool extends horizontally. In that case, the rounded recess should be embodied correspondingly hollow-cylindrically, expediently with a widened entrance region. Alternatively, the free end of the protrusion could be embodied with an upper and a lower wedge face, and the recess could be designed with complementary counterpart faces. In the preferred embodiment, however, two protrusions which on the free end are substantially in the shape of a spherical cap are mounted on the axially outer side of the first saddle and can be introduced into corresponding spherical caplike concave recesses with a conically widened entrance region in parts of the first bearing that are mounted on the side faces of the crossbar. The two spherical caplike protrusions, which in the mounted state are located horizontally side by side, permit simple introduction into the spherical cap shaped concave recesses with a widened entrance region, but then guide the gripper tool reliably into a position aligned with the longitudinal center plane of the crossbar, in which position the end phase of the pivoting motion occurs as the gripper tool is set down onto the crossbar.

On the end of the gripper tool opposite from the spherical caplike protrusions, in a further preferred feature of the invention, two wedges are mounted, with space between them, side by side on the axially outer side of the second saddle, and their effective outer wedge faces recede axially from top to bottom and come to rest on corresponding wedge faces, which are embodied on parts of the second bearing that are mounted on the side faces of the crossbar. Once again, the paired arrangement of wedge faces with a relatively great spacing between them is favorable for automatically aligning the gripper tool with the center longitudinal plane of the crossbar. For the same reason, if possible, the two wedge faces on the second saddle should be located in the same straight plane.

The locking of the gripper tool in its predetermined position is intended to cause it to maintain its position on the crossbar. In a preferred feature of the invention, this is attained in a simple way by providing that on each of the two lateral parts of the second bearing, one locking bolt each, extending in the longitudinal direction of the crossbar, is supported axially displaceably and in the wedged position can be introduced through the wedge faces into an aligned bore in the associated wedge on the second saddle. Because in this version the free end of the locking bolt and/or the entrance region of the bore is embodied as wedge-shaped or conical, it is attained that the locking bolt contributes to pulling the second saddle into the predetermined end position on the crossbar. Moreover, by a suitable disposition and dimensioning of the parts, it is attained that the wedges connected to the second saddle, as they are lowered or dropped down, automatically press the locking bolts, which are preferably prestressed in the locking direction by springs, back until they snap into the associated bores and lock there.

In the same way as the automatic positioning and locking are attained, the pneumatic connections of the gripper tool can also be automatically connected to one or more supply lines, in that the second bearing and the second saddle are provided with coupling parts, fitting one another, of pneumatic couplings of one or more underpressure lines, which enter into coupling engagement upon pivoting of the gripper tool into the wedged position.

An exemplary embodiment of the invention will be described in further detail below in conjunction with the accompanying drawings.

DESCRIPTION OF THE PREFERRED EMBODIMENT

Figure 1:
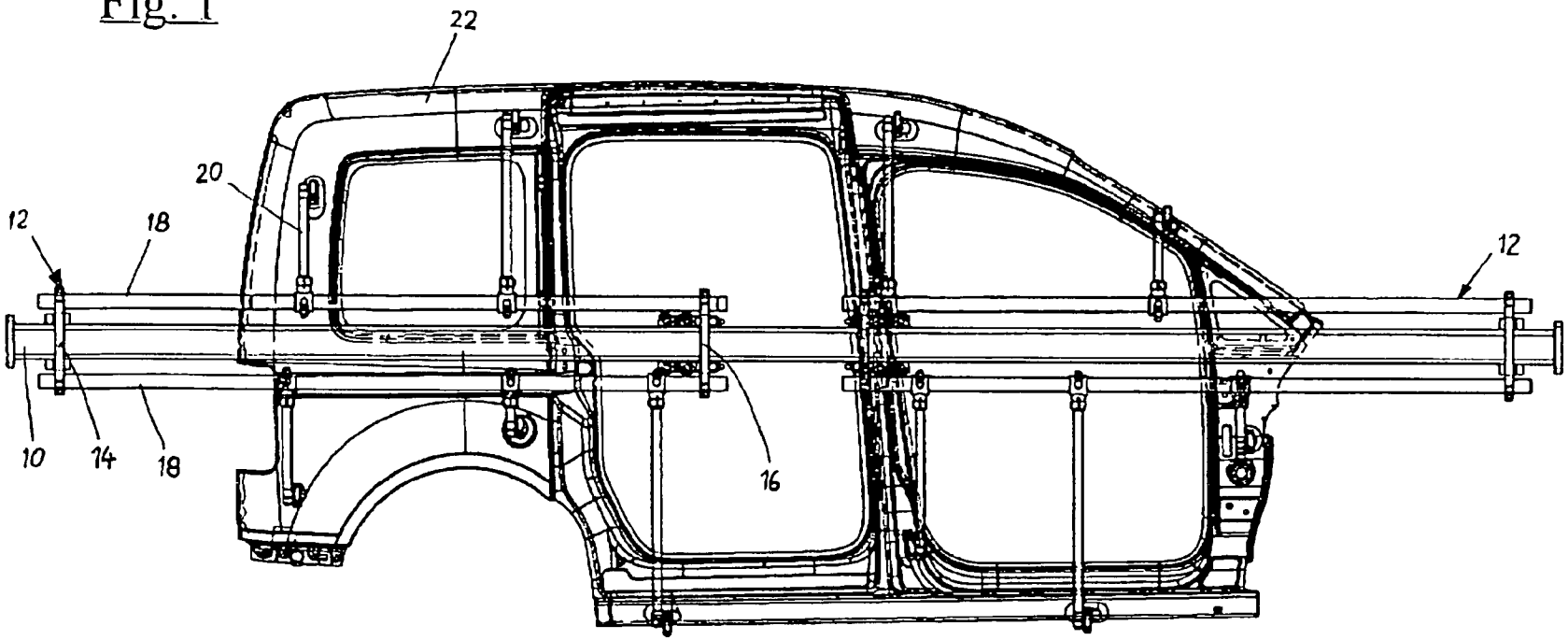
FIG. 1 is a plan view on a movable crossbar of a transfer press, with two gripper tools secured to it, whose suction grippers in this example support a side panel of a motor vehicle.

FIG. 1 shows only schematically, and not in detail, the attachment of two gripper tools according to the invention to the transversely movable crossbar 10 of a large-scale transfer press. The gripper tools, identified overall by reference numeral 12 (and also known as suction bridges), each comprise two axially spaced-apart saddles 14, 16, which are solidly joined to two axially extending tubes 18, for instance of aluminum, and form an intrinsically rigid unit. Suction grippers 20 connected to a source of underpressure are secured to the tubes 18 in such a form and arrangement that overall they can grasp and hold a certain workpiece 22 at predetermined points, in order to transport it from one processing station of the large-scale transfer press to the next. If a workpiece of a different shape is then to be formed on the press, the gripper tools 12 are replaced by the same kind of gripper tools, which can be secured in the same way to the same point of the crossbar, but which differ only in the shape and disposition of the section grippers 20.

Because of the high capital investment costs of large-scale transfer presses, the changeover times for removing certain gripper tools and installing gripper tools adapted to the next workpiece to be processed or machined must be as short as possible. Moreover, despite short changeover times, the system for securing the gripper tools 12 must assure very precise positioning and reliable locking in the predetermined position.

Figure 4:
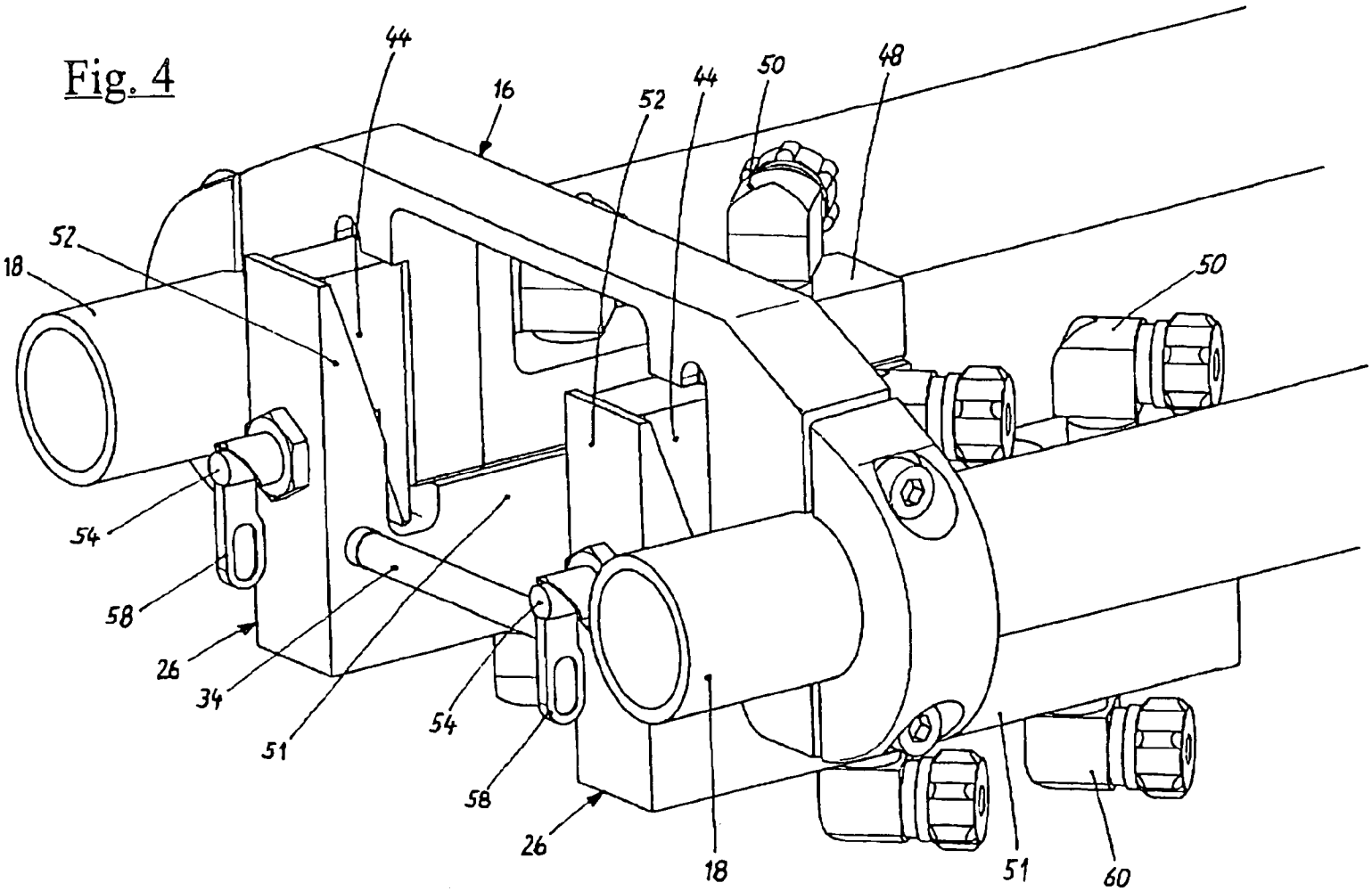
FIG. 4 is an oblique view of the outside of the second saddle of one of the gripper tools of FIG. 1 in the mounted state.
Figure 5:
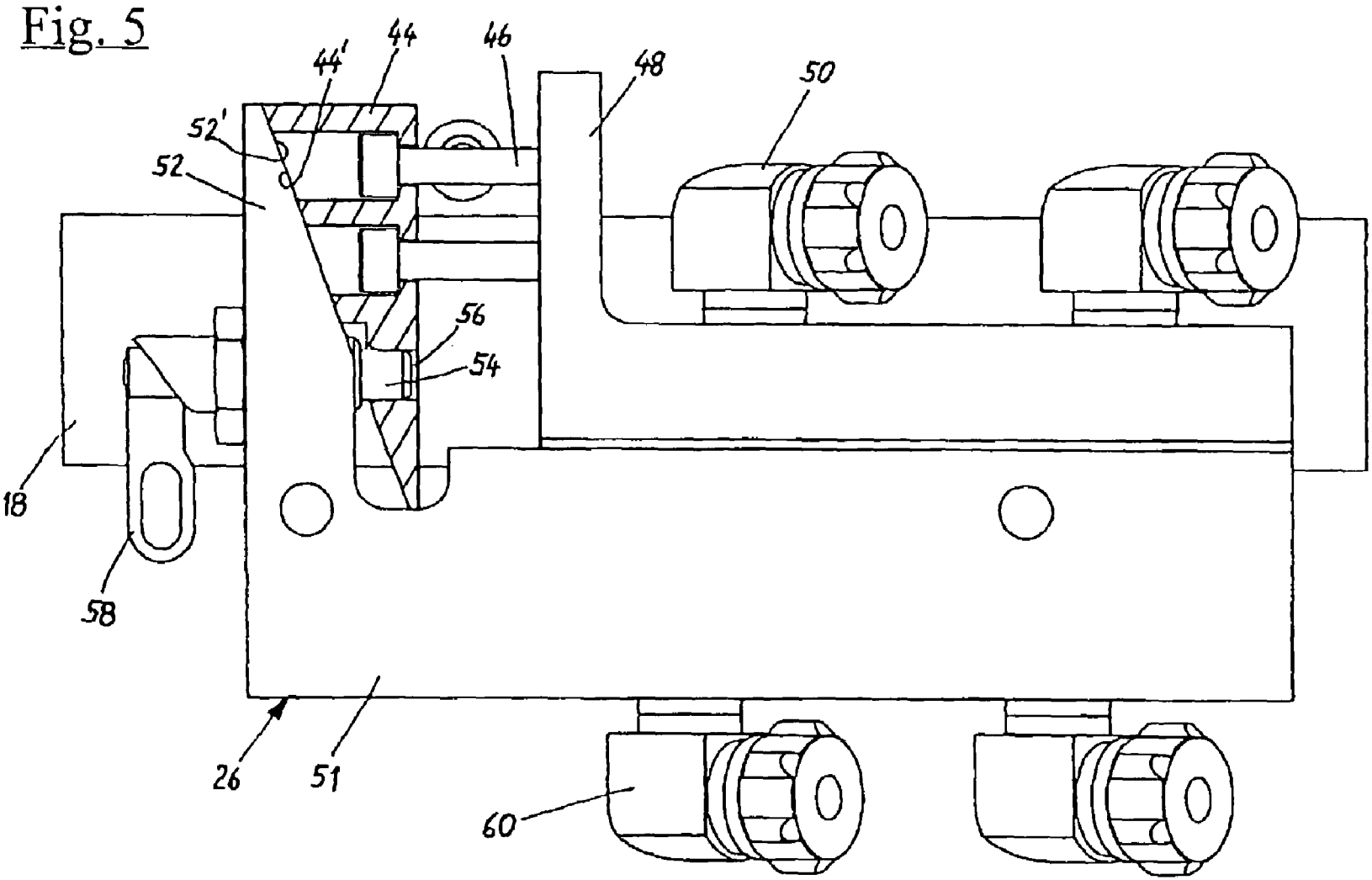
FIG. 5 is a side view, partly in longitudinal section through the second bearing with a locking bolt and through the parts that are secured to the second saddle and cooperate with the second bearing; as in FIGS. 2 through 4, for the sake of clarity of the drawing, neither the crossbar nor in this case the second saddle either is shown.

As in the fastening system described in U.S. Pat. No. 5,746,567, the gripper tools 12 are set down from above onto the crossbar 10 with their saddles 14, 16, so that in the mounted state, the essentially U-shaped saddles 14, 16 are seated on the top of the crossbar 10 and embrace its upper side edges. For precise positioning and locking of the saddles 14, 16, a first bearing 24, shown in FIGS. 2 and 3, and a second bearing 26, shown in FIGS. 4 and 5, are fixedly attached to the crossbar 10, spaced apart from one another. The proposed, novel method and the novel bearing assembly proposed for performing it differ from the known bearing assembly of U.S. Pat. No. 5,746,567 in the type of positioning and fastening means mounted on the respective cooperating bearings and saddles and in the manipulation during the changeover.

Figure 2:
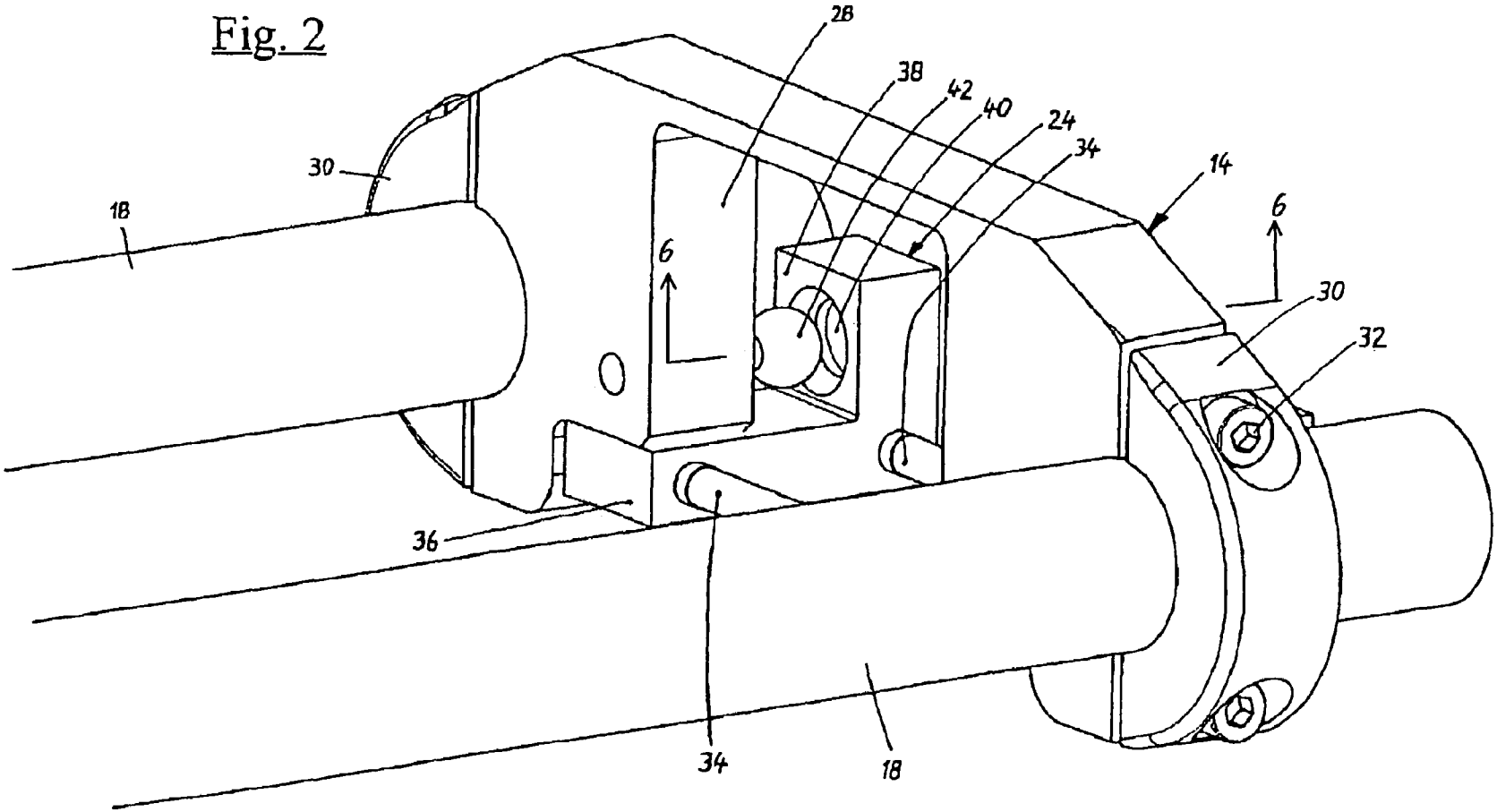
FIG. 2 is an oblique view of the inside of a first saddle of one of the two gripper tools of FIG. 1, immediately before it is connected to the crossbar.
Figure 3:
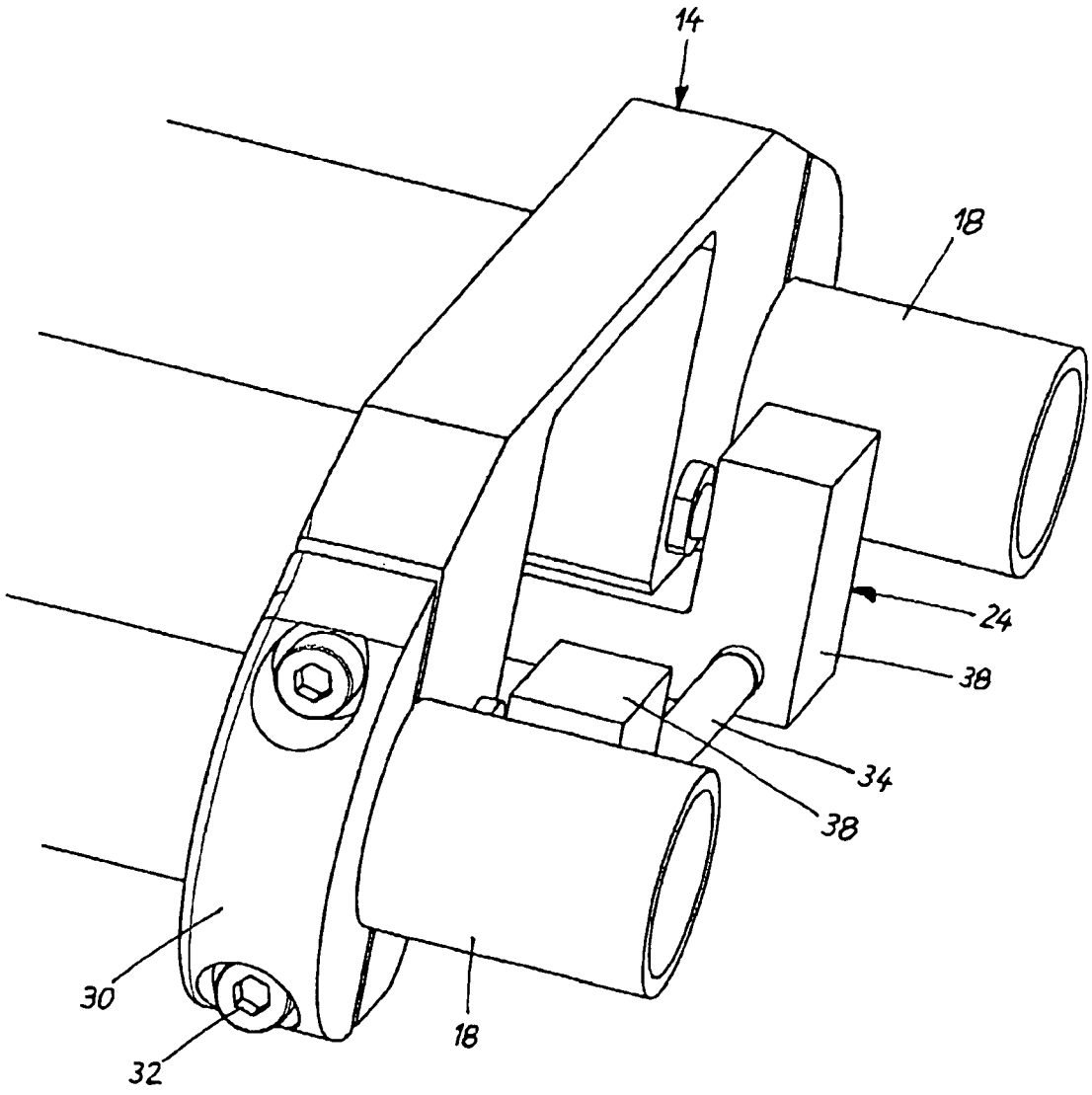
FIG. 3 is an oblique view of the outside of the first saddle of FIG. 2, after its connection to the crossbar.
Figure 6:
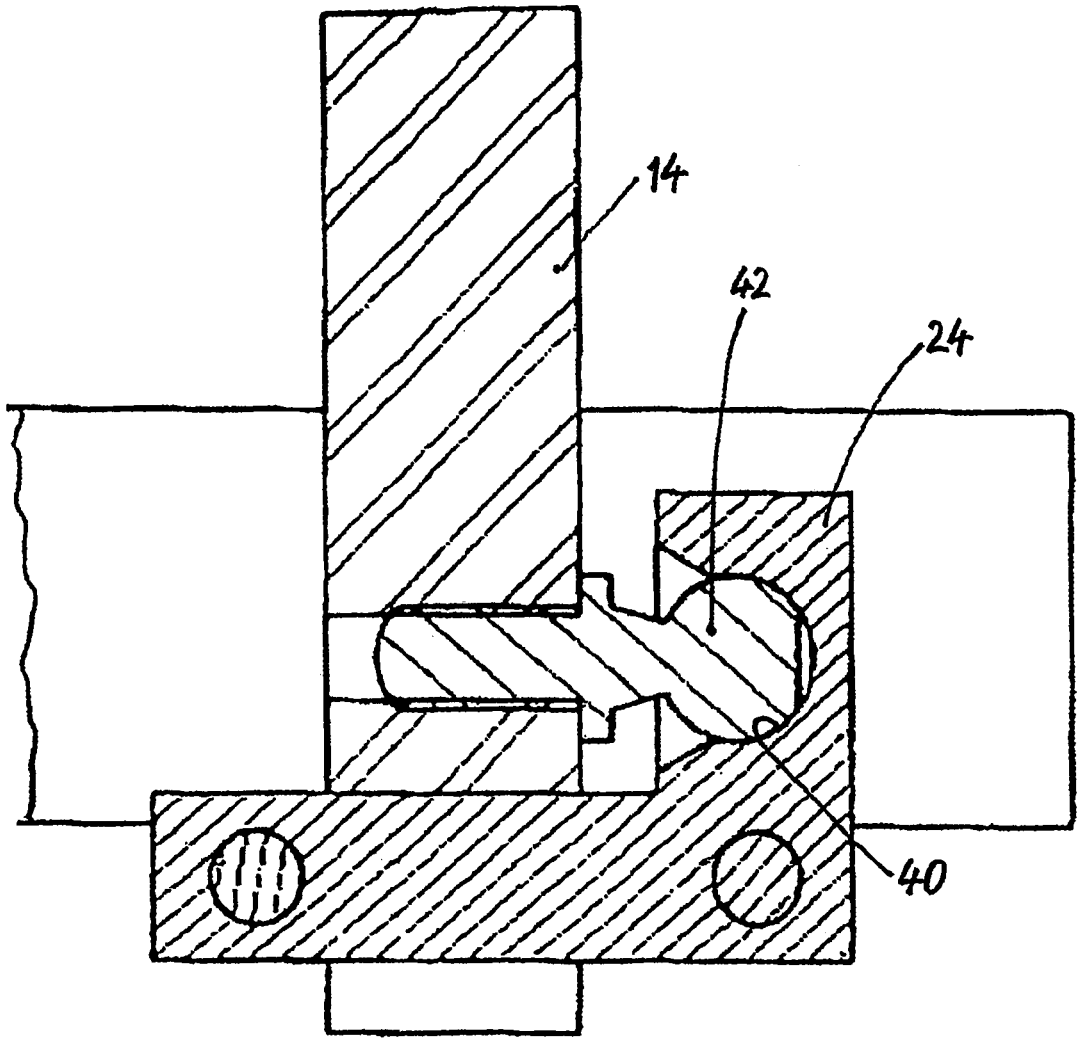
FIG. 6 is a cross sectional view of the first saddle of one of the two gripper tools taken along line 6-6 of FIG. 2.

In FIGS. 2, 3 and 6 with reference to the gripper tool 12 shown on the left in FIG. 1, the outer, first saddle 14 is shown with details, along with the first bearing 24 secured to the crossbar 10, not shown. The U-shaped recess through which the crossbar 10 extends is identified by reference numeral 28. For connection to the tubes 18, the saddle 14 is embodied with longitudinally divided fitting bores on the sides. The divided outer side parts 30 of the saddle 14 are joined to its middle part by clamping screws 32. The tubes 18 are firmly fastened in the bores that receive them by tightening the clamping screws 32.

The bearing 24, cooperating with the first saddle 14 and secured to the crossbar 10, comprises two bearing halves of matching shape, each of which is mounted on one side of the crossbar 10. The two halves of the bearing 24, in this example, are screwed together via bolts 34 that extend horizontally crosswise through the crossbar 10. As a result of the bracing to the crossbar 10 via the bolts 34 or corresponding tubes, the two halves of the first bearing 24 are seated immovably firmly in a parallel arrangement on the side faces of the crossbar 10. Alternatively, the bearing halves could be screwed individually to the side faces of the crossbar.

Each of the two halves of the first bearing 24 comprises a solid L-shaped angle piece of steel, whose lower leg 36, in the mounted state, extends horizontally in the longitudinal direction of the crossbar 10. At its axially outer end, it changes over into a vertically upward-extending leg 38. In the mounted state of the gripper tool 12, it is located on the axially outer side of the first saddle 14. A rounded recess 40 is machined into the vertical leg 38, on its axially inner side, toward the saddle 14. In this example, this recess has the form of a circular, axially extending blind bore, with a not entirely hemispherical caplike concave inner region and with an entrance region that widens conically toward the outside.

For cooperation with the bearing 24 having the two rounded recesses 40, two spherically rounded protrusions 42 are mounted on the outside of the first saddle 14, with the same transverse spacing as the recesses 40 in the bearing 24 and adapted to the spherical caplike concave cross section of those recesses. (See, e.g. FIG. 6.) Behind the approximately hemispherical outer end, the cross section of the protrusions 42 tapers. This tapering, like the widening of the entrance region of the recesses 40, serves the purpose of being able to introduce the protrusions 42 into the recesses 40 in a position of the gripper tool 12 that is inclined, obliquely dropping, toward the first saddle 14, while the saddle 14 is braced on the horizontal legs 36 of the bearing 24. In the lowering of the second saddle 16, the rounded protrusion 42 can penetrate all the way into the rounded recess 40. At the end, the saddle 14 is centered relative to the cross section of the crossbar 10 by the engagement of the protrusions 42 with the recesses 40, or in other words is aligned precisely in terms of both level and laterally.

The second saddle 16, shown in its details in FIGS. 4 and 5 along with the second bearing 26, is solidly joined to the tubes 18 in the same way as the first saddle 14. The U-shaped inner recess for receiving the crossbar 10 also matches the corresponding recess 28 of the first saddle 14. In a distinction from it, however, on the axially outer side of the second saddle 16 to both sides of the U-shaped recess, a respective wedge 44 is mounted, whose axially outer effective wedge face 44', in the mounted state, approaches the axially outer face of the second saddle 16 from the top, moving downward. As seen from FIG. 5, each wedge 44 is solidly connected to a solid, L-shaped angle piece 48 and braced via screw bolts 46, which extend axially through the second saddle 16; this angle piece has coupling halves, not shown, of pneumatic couplings and also has line connections 50 for underpressure lines, which supply the suction grippers 20 with underpressure.

The second bearing 26, in a way corresponding to the first bearing 24, comprises two L-shaped angle pieces, mounted on the side faces of the crossbar 10 and joined to one another and to the crossbar 10 by screw bolts 34, each with one horizontal leg 51, extending in the longitudinal direction of the crossbar 10 in the mounted state, and one vertical leg 52, rising in front of the axially outer side of the second saddle 16. The axially inner side of each vertical leg 52 is provided with a wedge face 52' that fits the axially outer wedge face 44' of the wedge 44. In the mounted state of the gripper tool shown in FIGS. 4 and 5, the wedge faces 44' and 52' rest flatly on one another, while the tubes 18 extend parallel to the center longitudinal axis of the crossbar 10. This mounted end position is secured by two locking bolts 54, which extend, likewise each parallel to the center longitudinal axis of the crossbar 10, through the associated wedgelike vertical leg 52 of the second bearing 26 and engage a fitting axial bore 56 in the wedge 44. Each locking bolt 54 is embodied with a conical oblique face on its free end, and the entrance region of the bore 56 in this example is also provided with a conical widening. Each locking bolt 54 is prestressed in the locking direction by a spring, not shown, but may also be retracted to a neutral position by means of a handle 58 mounted on it, by rotation via a cam guide, in which neutral position the handle 58, which points downward in the locking position, points vertically upward.

Coupling halves, not shown, of pneumatic couplings are mounted on the horizontal legs 51 of the second bearing 26; in the mounted position shown in FIGS. 4 and 5, they are in aligned engagement with the correspondingly embodied halves, mounted on the second saddle 16, of the pneumatic couplings, so that the aforementioned underpressure lines of the suction grippers 20 are connected to underpressure supply lines, not shown, via the connections 50, the pneumatic couplings, not shown, and line connections 60 disposed on the underside of the horizontal legs 51 of the second bearing 26.

Mounting the gripper tools 12 on the crossbar 10 is very simple and proceeds largely automatically, despite the simple mechanical means described. At the beginning of the assembly process it suffices to set the first saddle 14 down on the horizontal legs 36 of the first bearing 24 and, in a slanting position of the tubes 18 relative to this bearing, to introduce the rounded protrusions 42 into the rounded recesses 40. After that, one need merely allow the other end of the gripper tool 12, that is, the second saddle 16, to drop from a low height onto the second bearing 26. In the falling motion, the lower ends of the wedges 44 press the locking bolts 54 axially outward back; the wedge faces 44' and 52' come to rest on one another, and as a result of the wedging action, the overall gripper tool 12 is displaced axially farther toward the first bearing 24, so that there the protrusions 42, with their hemispherical free ends, come into contact with the hemispherical concave bottom faces of the recesses 40, and the gripper tool 12 is axially firmly fastened between this axial bearing point and the wedge faces 52' and is thereby exactly positioned. The locking bolts 54 in cooperation with their receiving bores 56 provide for the maintaining of this situation. Normally, the second saddle 16 drops on its own far enough that the locking bolts 54 are aligned with the receiving bores 56. Should that not yet be entirely the case, a sufficiently strong spring prestressing of the locking bolts, optionally supplemented by manual pressure, forces their conical free end into the associated receiving bore and thus forces the second saddle 16 into the predetermined mounted position, in which the tubes 18 extend horizontally and parallel to the center longitudinal axis of the crossbar 10.

It is understood that the locking bolt may engage the second saddle 16, or some part connected to it, in a different position and/or at a different point. However, the locking arrangement proposed in the exemplary embodiment on the wedge faces 44', 52' which are required anyway for precise positioning is more economical than another version, with which the attempt is again made to cause the locking bolts to engage automatically. A further consideration is that the locking bolts 54 in cooperation with the receiving bores 56 assure a precise lateral alignment of the second saddle/16 relative to the crossbar 10.

Figure 7:
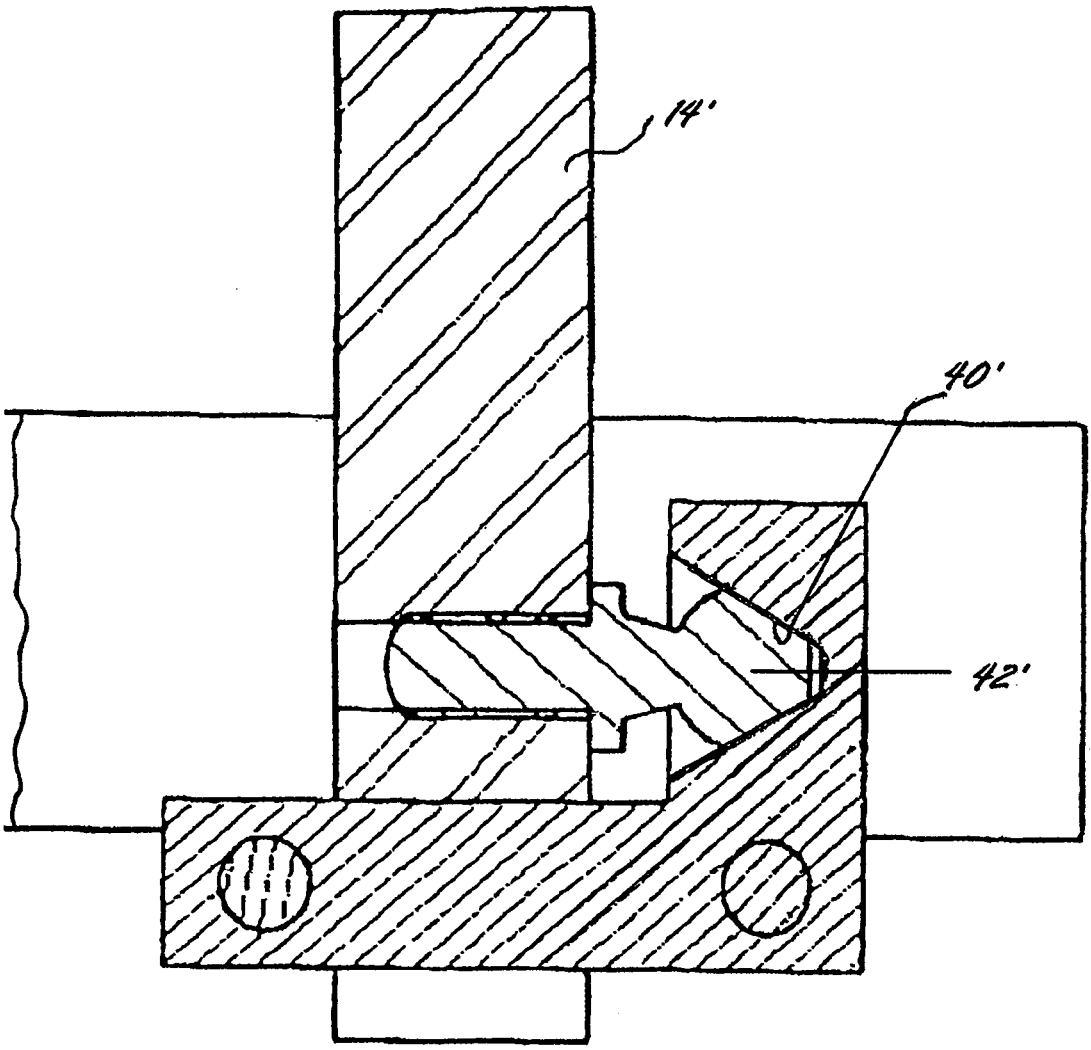
FIG. 7 is a cross sectional view of another first saddle of one of the two gripper tools in accordance with an alternative embodiment in accordance with the present invention.

Alternative embodiments are also possible in the design of the rounded protrusions 42 and of the recesses 40. Instead of a hemispherical free end of the protrusions 42, a semicylindrical free end of the protrusions 42, for example, with a horizontal cylinder axis extending crosswise to the longitudinal direction of the crossbar 10, or a wedge, or a wedgelike free end with one upper and one lower wedge face, could be employed. For example, referring to FIG. 7, with a wedgelike shaped free end or protrusion 42' and corresponding recess 40', the functionally required pivoting motion of the gripper tool 12 in the assembly on the crossbar 10 can also be executed.

It is understood that furthermore the external shape of the saddles 14, 16, their connection to the tubes 18, and the external shape of the bearings 24, 26 and their connection to the crossbar 10 allow many different variant embodiments.

For instance, the protrusions 42 may be mounted on the bearing 24 and the recesses 40 on the saddle 14, and they can equally well, as optionally can the wedge faces 44', 52', be located on the axially inner side of the respective saddle 14 or 16. Such modifications are no problem, as long as the inward pivoting of the gripper tool 12 as shown and described above into the predetermined position on the crossbar 10 can be executed.

The invention claimed is:

1. A method for detachably securing a gripper tool to a movable crossbar of a transfer press, which gripper tool has a first saddle and a second saddle disposed with spacing between them and with them is brought into engagement with a first bearing and a second bearing mounted on the crossbar and is locked in a defined engagement position, wherein the gripper tool, in an inclined position relative to the center longitudinal axis of the crossbar, is introduced, with at least one protrusion of rounded longitudinal section or tapering in wedgelike fashion, on the first saddle into a correspondingly rounded or V-shaped narrowing recess in the first bearing and is then pivoted with the second saddle toward the crossbar, whereupon wedge faces on the second saddle and on the second bearing press the protrusion by the force of gravity axially against a wall of the recess, and then the second saddle is locked to the second bearing.

2. The method according to claim 1, wherein for locking the second saddle to the second bearing, at least one locking bolt, guided axially in the second bearing, is introduced, in the direction parallel to the center longitudinal axis of the crossbar, into a fitting bore in the second saddle.

3. The method according to claim 2, wherein during the locking, the gripper tool is pivoted into a predetermined end position by means of cooperating wedge or conical faces on the locking bolt and on the bore.

4. The method according to claim 1, wherein in the pivoting of the gripper tool into a predetermined end position, underpressure supply lines are connected to underpressure lines on the tool via cooperating pneumatic couplings on the second bearing and on the second saddle.

5. A bearing assembly for detachably securing a gripper tool to a movable crossbar of a transfer press, which gripper tool can be clamped in clamping engagement and locked by positive engagement, a first saddle and a second saddle spaced apart from one another, to a first bearing and a second bearing mounted on the crossbar wherein the first saddle can be introduced, with at least one protrusion mounted on it and having a rounded longitudinal section or tapering in wedgelike fashion, already in an inclined position of the gripper tool relative to the center longitudinal axis of the crossbar, into a correspondingly rounded or V-shaped narrowing recess in the first bearing, and in an engagement position the gripper tool can be pivoted with the second saddle toward the crossbar; that the second saddle and the second bearing are provided with wedge faces, which in the course of the pivoting motion come to rest on one another, by which faces the protrusion can be pressed axially against a wall of the recess by the force of gravity; and that in this braced position, the second saddle can be locked to the second bearing.

6. The bearing assembly according to claim 5, wherein two protrusions which on the free end are substantially in the shape of a spherical cap are mounted on the axially outer side of the first saddle and can be introduced into corresponding spherical caplike concave recesses with a conically widened entrance region in parts of the first bearing that are mounted on side faces of the crossbar.

7. The bearing assembly according to claim 6, wherein two wedges are mounted, with space between them, side by side on the axially outer side of the second saddle, and their effective outer wedge faces recede axially from top to bottom and come to rest on corresponding wedge faces, which are embodied on parts of the second bearing that are mounted on side faces of the crossbar.

8. The bearing assembly according to claim 7, wherein the parts, mounted on opposite side faces of the crossbar of the first bearing and of the second bearing, respectively, are each pressed against the crossbar by mutual bracing.

9. The bearing assembly according to claim 7, wherein on each of the two lateral parts of the second bearing, one locking bolt each, extending in the longitudinal direction of the crossbar, is supported axially displaceably and in a wedged position can be introduced through the wedge faces into an aligned bore in the associated wedge on the second saddle.

10. The bearing assembly according to claim 9, wherein a free end of the locking bolt and/or the entrance region of the bore is embodied as wedge-shaped or conical.

11. The bearing assembly according to claim 10, wherein the locking bolt, on pivoting of the gripper tool into the wedged position can be forced back counter to spring force by the wedge face on the second saddle, and after reaching a wedged position can be advanced into the locking position by a spring force.

12. The bearing assembly according to claim 9, wherein the locking bolt is prestressed into the locking position by spring force.

13. The bearing assembly according to claim 5, wherein two protrusions that on the front end are substantially semicylindrical are mounted on the axially outer side of the first saddle with a horizontal cylinder axis extending transversely to the crossbar and can be introduced into correspondingly semicylindrically concave recesses with an entrance region, widened in wedgelike fashion, in parts of the first bearing that are mounted on side faces of the crossbar.

14. The bearing assembly according to claim 5, wherein the second bearing and the second saddle are provided with coupling parts, fitting one another, of pneumatic couplings of one or more underpressure lines, which enter into coupling engagement upon pivoting of the gripper tool into a wedged position.

* * * * *